US007207184B2

(12) United States Patent
Jessen et al.

(10) Patent No.: US 7,207,184 B2
(45) Date of Patent: Apr. 24, 2007

(54) METHOD FOR REGULATING A MOST LOADED CIRCUIT IN A MULTI-CIRCUIT REFRIGERATION SYSTEM

(75) Inventors: Lars Mou Jessen, Nordborg (DK); Christian Bendtsen, Soenderborg (DK)

(73) Assignee: Danfoss A/S, Nordborg (DK)

( * ) Notice: Subject to any disclaimer, the term of this patent is extended or adjusted under 35 U.S.C. 154(b) by 208 days.

(21) Appl. No.: 10/843,756

(22) Filed: May 12, 2004

(65) Prior Publication Data

US 2005/0252222 A1 Nov. 17, 2005

(51) Int. Cl.
*F25B 49/00* (2006.01)
*F25B 7/00* (2006.01)

(52) U.S. Cl. ..... 62/175; 62/217; 62/200; 62/223

(58) Field of Classification Search ..... 62/175, 62/217, 200, 223, 199, 510, 206, 204, 228.1, 62/228.3, 228.4, 228.5
See application file for complete search history.

(56) References Cited

U.S. PATENT DOCUMENTS 4,084,388 A 4/1978 Nelson ..... 62/152
5,867,995 A * 2/1999 Lewis ..... 62/115
6,301,911 B1 * 10/2001 Reason et al. ..... 62/196.2
6,449,968 B1 * 9/2002 Singh et al. ..... 62/175

FOREIGN PATENT DOCUMENTS

WO WO 01/67014 A1 9/2001

* cited by examiner

*Primary Examiner*—Chen-Wen Jiang
(74) *Attorney, Agent, or Firm*—McCormick, Paulding & Huber LLP

(57) ABSTRACT

A method for regulating a most loaded circuit of a refrigeration system is provided. Each circuit includes at least one case and an EEPR valve. At least one controller communicates with the EEPR valves for receiving signals from the circuits corresponding to operating conditions for each circuit, and for issuing command signals to the EEPR valves and compressor. The operation of each circuit is monitored and a load signal is calculated for each circuit. The load signals for each circuit are compared and the most loaded circuit is determined. The EEPR valve of the most loaded circuit is adjusted to be approximately 100 percent open and a suction pressure of the compressor is adjusted to move a circuit temperature of the most loaded circuit to a target temperature. The process of selecting and regulating the most loaded circuit is repeated after a predetermined period of time.

11 Claims, 1 Drawing Sheet

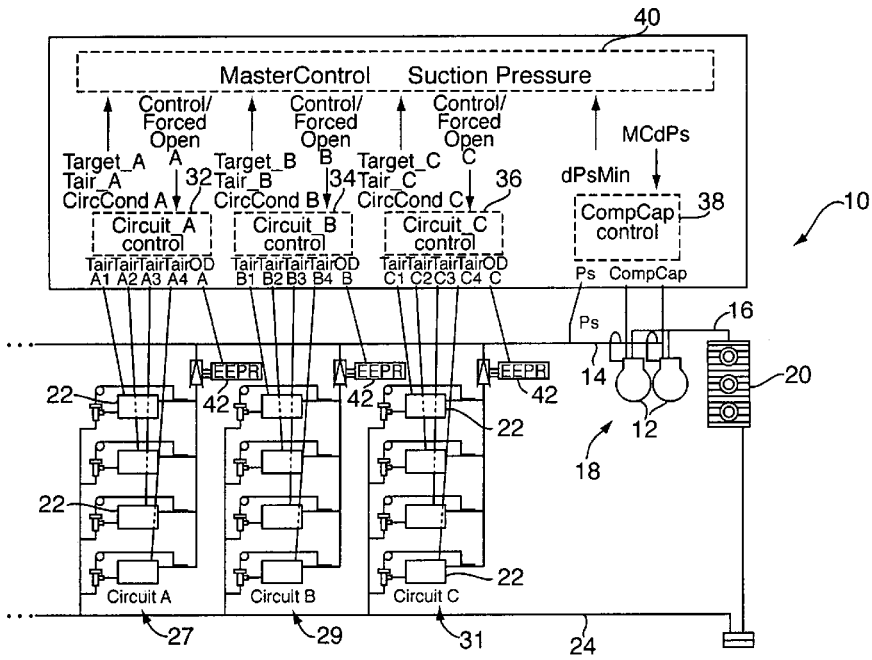

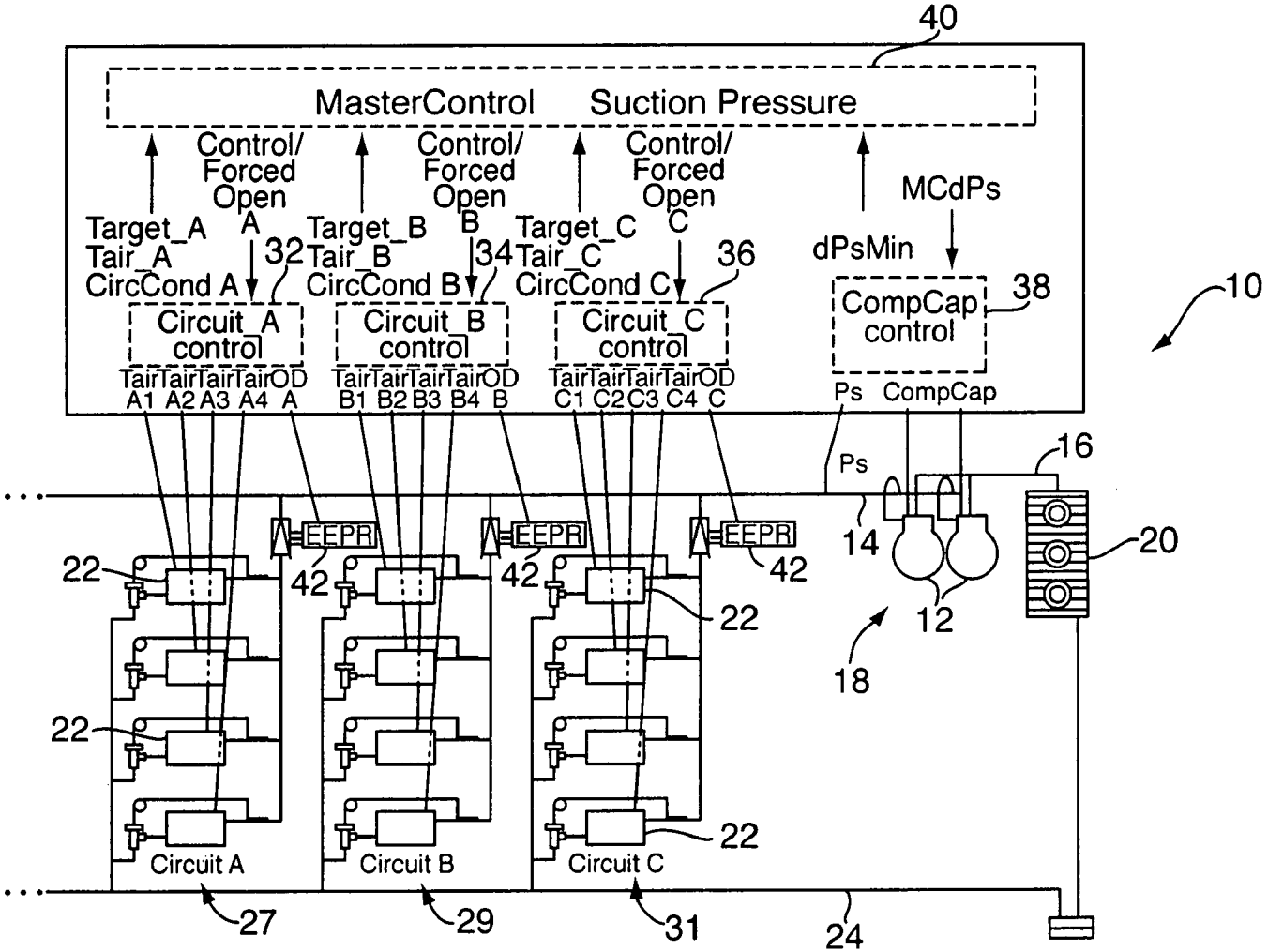
10
20
16
38
40
MCdPs
dPsMin
CompCap control
CompCap
Ps
12
14
18
24
42
EEPR
22
36
Control/ Forced Open C
Target_C
Tair_C
CircCond C
Circuit_C control
TairTairTairTairOD C1 C2 C3 C4 C
31
Circuit C
34
Control/ Forced Open B
Target_B
Tair_B
CircCond B
Circuit_B control
TairTairTairTairOD B1 B2 B3 B4 B
29
Circuit B
32
Control/ Forced Open A
Target_A
Tair_A
CircCond A
Circuit_A control
TairTairTairTairOD A1 A2 A3 A4 A
27
Circuit A
MasterControl
Suction Pressure

METHOD FOR REGULATING A MOST LOADED CIRCUIT IN A MULTI-CIRCUIT REFRIGERATION SYSTEM

FIELD OF THE INVENTION

The present invention is generally related to the operation of refrigeration systems having more than one circuit, and is more particularly directed to a method for regulating such systems which includes determining which circuit is most loaded.

BACKGROUND OF THE INVENTION

In a basic refrigeration system, a compressor is used to set a specific refrigerant pressure at the inlet side of the compressor. This is called the suction pressure and all associated connections are referred to as suction side connections. As a byproduct of setting the suction pressure, a refrigerant pressure is also established at the outlet side of the compressor. This is called the head pressure, with all associated connections referred to as head side. Since the head pressure is the direct result of refrigerant compression, the head side refrigerant is at a significantly higher pressure and temperature than the suction side.

In the basic system, the head side is connected to a condenser which reduces the temperature of the pressurized refrigerant in order to condense the refrigerant back into a liquid. This high pressure liquid is then supplied to an expansion valve which meters this refrigerant into an evaporator as a mixture of vapor and liquid. The evaporator typically is a finned tubular assembly which is built directly into a refrigerated fixture or case. In the evaporator the liquid refrigerant evaporates while absorbing heat from the evaporator surroundings. Within the fixture, fans create a circular flow of air past the products to be refrigerated and through the evaporator. In this manner, air warmed by the products within the fixture is subsequently cooled as it passes through the evaporator. To physically complete the system, the outlet of the evaporator is connected directly to the suction side of the compressor. The evaporator could also cool water which is then used for cooling purposes.

One characteristic of the metering process, where refrigerant is supplied into the evaporator via an expansion valve, is that the refrigerant experiences a significant pressure drop since the orifice of the expansion valve is significantly smaller than the cross section of the evaporator. Thus, the refrigerant pressure within the evaporator is effectively set by the suction side and not the head side of the system. Since a refrigerant's evaporation pressure and temperature are directly linked in a one-to-one manner, it is apparent that any device which controls the suction side pressure at the evaporator will directly control the evaporation temperature of the refrigerant within that evaporator and thus the minimum temperature which can be obtained within a circuit defined as a collection of refrigerated fixtures or cases having evaporators being interconnected and sharing a common evaporation pressure. One or more refrigerant compressors sharing a common suction side and a common head side is referred to by those skilled in the pertinent art as a rack. The head sides of compressors forming a rack are also associated with a refrigerant condenser.

In a typical supermarket, it's necessary to maintain different product groups at different temperatures (examples would include ice cream, frozen food, fresh meat, dairy, and produce). Since the quantity of each product type typically requires multiple refrigerated fixtures hereinafter referred to as cases, these cases are connected together to create circuits. In a circuit, a collection of refrigerated cases share a common supply and return piping for the required refrigerant. However, since rack systems which supply the refrigerant are costly, it is common to implement a reduced number of racks (e.g., a minimal configuration would consist of one rack, but typically includes one low temperature rack and one medium temperature rack). Consequently, head side connections from a single rack are via a condensor associated with the rack connected to various circuits which operate at different temperatures. One common solution to achieving unique circuit temperatures is to install mechanical Evaporator Pressure Regulator (EPR) valves on the return line from each circuit prior to connection to the suction side of the rack. Each evaporator pressure regulator valve, usually set by a refrigeration mechanic when the system is initially commissioned, works to establish a specific evaporation pressure, and thus a specific temperature, within the evaporators of the associated circuit. However, since the initial setting does not typically change, this approach prevents any type of dynamic system response and thereby dynamic regulation of circuit temperature necessitated by seasonal changes, improperly or overloaded cases and the like. In lieu of mechanical valves, electronically controlled EPRs, or EEPRs, are the preferred solution since an associated control algorithm may be implemented to achieve the desired circuit temperature regardless of fluctuations in either the store environment or the performance of the racks themselves.

One known method of controlling a multi-circuit refrigeration system is to select a lead circuit from a plurality of circuits, each including at least one refrigeration case. The lead circuit being defined as the circuit having the lowest temperature set point. A suction pressure set point for a compressor rack is initialized based upon the identified lead circuit. Changes in suction pressure set point are determined based on measured parameters from the lead circuit. The suction pressure set point is updated until the EEPR for the lead circuit is approximately 100% open. A problem associated with this type of refrigeration system is that the lead circuit will not necessarily be the circuit requiring the lowest suction pressure. For example, in a situation where a popular item is located in the refrigeration cases of a particular circuit, because of high turnover, that circuit may require more refrigeration, i.e. be more loaded, than other circuits in the system having lower temperature set points. In this case a lower suction pressure will provide the necessary additional refrigeration. In addition, poor case design in a circuit can also lead to heavy loading. If such a poorly designed circuit should be able to maintain the intended temperature, the circuit would require a low suction pressure to deliver the required refrigerating capacity. Another example is that different types of cases can have different energy efficiencies. Moreover, goods might accidentally be stacked wrongly in a case so that the refrigerated airflow from the evaporator does not flow correctly, whereby the refrigerating capacity is lowered. This results in a more loaded case. Accordingly, if the circuit having the lowest temperature set point does not correspond to the circuit under greatest load, a system configured in the above-described manner will not operate properly.

Based on the foregoing, it is the general object of the present invention to provide a method for controlling a refrigeration system that overcomes or improves upon the problems and drawbacks of the prior art.

SUMMARY OF THE INVENTION

The present invention is directed in one aspect to a method for regulating a circuit temperature of a most loaded circuit in a multi-circuit refrigeration system having two or more circuits, each including at least one refrigeration case. Each of the circuits is in communication with an electronic evaporator pressure regulator valve being operable to regulate the evaporation pressure in the circuit, and thereby the temperature in the cases associated with the circuit. At least one controller forms part of the refrigeration system and is in communication with the electronic evaporation pressure regulator valves. During operation of the refrigeration system, the controller monitors each of the circuits, including sensor dependant signals, particularly temperature signals, for a period of time and determines a load for each circuit. The controller determines which of the circuits is currently under the greatest load, designating that circuit as the most loaded circuit. The meaning of the term "most loaded circuit" (MLC) will be further explained in detail hereinbelow.

Once the most loaded circuit is determined, the controller issues commands to the electronic evaporator pressure regulator valve associated with the most loaded circuit causing it to assume an approximately 100% open configuration while the compressor capacity is either increased or decreased in order to bring the circuit temperature of the most loaded circuit to a target temperature. After a predetermined period of time, the controller again determines which circuit is the most loaded circuit and, if a new MLC has been found, returns the previously selected MLC to normal operation, sets the EEPR associated with the new MLC to substantially 100% open and readjusts the compressor capacity as required. The purpose of this approach is to operate the refrigeration system with the highest possible suction pressure while still being able to maintain the desired temperatures in the circuits. The higher the suction pressure, the more energy efficient the operation of the refrigeration system.

In the preferred embodiment of the present invention, each circuit has an associated circuit controller for regulating a circuit temperature. There are several possibilities for the selection of a characterizing circuit temperature used to regulate the circuit temperature, for example, the temperature corresponding to the case operating at the highest temperature, the temperature corresponding to the case operating at the lowest temperature, an average of the case temperatures in a circuit, a weighted average of the case temperatures in a circuit, or the temperature of a predetermined case in a circuit.

Each of the circuits may include one or more sensors which may be positioned in each case to monitor the case temperature and feed signals corresponding to the detected temperature back to the controller. The sensors can be positioned to detect discharge air temperature in each refrigeration case. In addition, sensors can also be employed to monitor return air temperature in each refrigeration case. Where both discharge and return air temperature are monitored the controller averages the two temperatures, preferably in a weighted manner, to arrive at an overall case temperature, which may be used in the determination of a circuit temperature as described above.

BRIEF DESCRIPTION OF THE DRAWING

The sole FIGURE schematically illustrates a multi-circuit refrigeration system configured in accordance with the present invention.

DETAILED DESCRIPTION OF THE PREFERRED EMBODIMENT

A multi-circuit refrigeration system embodying the present invention is generally designated by the reference number 10. The system includes a plurality of compressors 12 each in communication with a common suction manifold 14 and a discharge header 16 cooperating to form a compressor rack 18. During operation, the compressor rack 18 compresses refrigerant vapor which is delivered to a condenser 20 where the refrigerant vapor is liquefied at high pressure. The high pressure liquid refrigerant is delivered to a plurality of refrigeration cases 22 via a conduit 24. The refrigeration cases 22 are arranged in groups referred to as circuits which share common supply and return piping, and have a common evaporation pressure. The illustrated multi-circuit refrigeration system 10 includes three circuits 27, 29 and 31. While each circuit 27, 29, 31 in the illustrated embodiment has been shown to include four refrigeration cases 22, the present invention is not limited in this regard as each circuit can include more or less than four cases without departing from the broader aspects of the present invention. Moreover, although only three circuits 27, 29, 31 are illustrated, the multi-circuit refrigeration system 10 can include more or less than three circuits.

The circuits 27, 29, 31 respectively communicate with circuit controllers 32, 34, 36 for sending information to the circuit controllers indicative of the circuit temperature of the circuits, to be explained more fully below. Preferably, each of the cases 22 within a circuit communicates with the associated circuit controller.

A compressor controller 38 is coupled to the compressor rack 18 for either increasing or decreasing the compressor capacity or suction pressure in order to regulate circuit temperatures in certain situations as explained more fully below.

A master controller 40 communicates with the circuit controllers 32, 34, 36 and the compressor controller 18 in order to determine, based on information received by the circuit controllers, which is the most loaded circuit. The most loaded circuit is the circuit having the highest load, wherein the load of each circuit is determined as the average temperature deviation between the actual circuit temperature and the circuit set point temperature over a predetermined period. Having determined the most loaded circuit the master controller 40 then sends command signals to the compressor controller 38 and the appropriate circuit controller whereby the circuit temperature of the most loaded circuit is adjusted towards a predetermined target temperature. In other words, the master controller 40 identifies the most loaded circuit based on the output of the circuit controllers 32, 34, 36 and then takes over the temperature control of the MLC and adjusts suction pressure so as to reach the target temperature of the MLC. Below follows a more detailed description of how the temperature of the MLC is controlled. The circuit controllers 32, 34, 36, the master controller 40 and the compressor controller 38 can physically be one unit or can be embodied in several units without departing from the scope of the present invention.

Each of the circuits 27, 29, 31 is set by the associated circuit controller to operate at a predetermined target temperature. The target temperature typically varies from circuit-to-circuit and depends on the products loaded in the cases. Since the temperature requirement can be different for each circuit, each circuit at an outlet thereof contains a pressure regulator 42, preferably in the form of an electronic evaporator pressure regulator (EEPR) valve. Each EEPR valve 42 is moved by a command signal from the associated circuit controller between an open and a closed position and a number of positions therebetween by a suitable drive, such as, but not limited to a stepper motor (not shown). During operation, each EEPR valve 42 disposed at an outlet of a circuit acts to control the evaporation pressure by modulating the flow of refrigerant, and thereby the temperature of the refrigerator cases 22 in the circuit with which the EEPR valve 42 is associated. Each refrigerator case 22 also includes its own evaporator and its own expansion valve for controlling the superheat of the refrigerant.

The circuit controllers 32, 34, 36 will normally and automatically make adjustments to the associated EEPR valves 42 if the circuit temperature cannot be kept at a target temperature or set point. The ability of a circuit to maintain set point temperature can depend on different factors. For example, the flow of goods going through the cases 22 can vary.

During operation of the refrigeration system 10, refrigerant is delivered through the conduit 24 to the evaporator associated with each refrigeration case 22. The refrigerant passes through an expansion valve where a pressure drop occurs to change the high pressure liquid refrigerant to a low pressure combination of liquid and vapor. As the warmer air in the refrigeration case 22 moves across the evaporator coil, the low pressure liquid turns into a gas. This low pressure gas is delivered to the EEPR valve 42 associated with a particular circuit. The gas pressure while passing through an EEPR valve 42 is further lowered. The gas returns to the compressor rack 18 where the gas is once again compressed to a high pressure liquid to start the refrigeration cycle over.

In the preferred embodiment of the present invention, temperature sensors (not shown) are mounted in each refrigeration case 22 and send signals indicative of the current operating temperature in the refrigeration case to the associated circuit controller. Each refrigeration case 22 can be configured to include one or more than one temperature sensor. Where a single sensor is employed in each refrigeration case 22, it is employed to measure the temperature of the discharge air from the refrigeration case. A pair of sensors can also be employed to measure both the discharge and the return air for a particular refrigeration case 22. Where only discharge air is being monitored, each circuit controller 32, 34, 36 receives signals from the temperature sensor in each refrigeration case 22 in the associated circuit and averages all of the temperatures to arrive at a circuit temperature.

Where both the discharge and return air temperatures in each circuit are monitored, each circuit controller 32, 34, 36 considers both either by averaging them for each refrigeration case 22 in the associated circuit and arriving at an average case temperature directly, or by calculating a weighted average based on a weighted combination of the temperature detected by the discharge air sensor and the return air sensor. For example, the discharge air temperature could be considered to account for 60% of the case temperature and the return air temperature for 40% of the case air temperature. Regardless of how the case air temperature is arrived at, a circuit temperature is determined by averaging the case temperatures for all of the refrigeration cases 22 in a particular circuit. Conversely, the circuit temperature can also be chosen as being equal to the highest case temperature, the lowest case temperature or the temperature of a predetermined case for the particular circuit.

Once the circuit controllers 32, 34, 36 determine the associated circuit temperatures, the circuit controllers each compare the associated circuit temperature with a target temperature or set point for the circuit. Based on this comparison, each circuit controller 32, 34, 36 generates a load for each associated circuit. Alternatively, the loads for each circuit can be determined by the master controller 40. In this case the circuit controllers 32, 34, 36 provide the circuit temperatures to the master controller 40, which then determines the load of the circuits. The load reflects, and is preferably proportional to the magnitude of the difference between the target temperature and the circuit temperature for the associated circuit over a period of time. The target temperatures can be programmed into the circuit controllers 32, 34, 36, selected from a menu displayed by the circuit controllers or can be manually input into the circuit controllers. If the master controller 40 determines the load of the circuits the target temperatures of the circuits are also provided to the master controller 40.

Moreover, information from each circuit 27, 29, 31 including the target temperature and the current operating or circuit condition (i.e., normal cooling mode or defrost mode) is sent from the circuit controllers 32, 34, 36 to the master controller 40 for determining which circuit has the largest load signal in the refrigeration system 10. The circuit with the largest loaded signal is designated by the master controller 40 as the "most loaded circuit" (MLC). The significances and determinations of the MLC will be explained in detail below.

The circuit temperatures are controlled by the circuit controllers 32, 34, 36. The circuit controllers 32, 34, 36 compensate for fluctuations in actual circuit temperatures from that of target circuit temperatures arising from factors such as, for example, different types of cases having different energy efficiencies, and goods being improperly loaded into the cases 22. The circuit controller 32, 34, 36 compensate for fluctuations in actual circuit temperatures from that of target circuit temperatures arising from factors such as, for example, different types of cases having different energy efficiencies and goods being improperly loaded into the cases 22. The circuit controllers 32, 34, 36 also handle the adjustments of the suction pressure done by the compressor controller 38 while adjusting the suction pressure in accordance with the MLC. The circuit controllers 32, 34, 36 also handle the adjustments of the suction pressure done by the compressor controller 38 while adjusting the suction pressure in accordance with the MLC. By so doing, more accurate control of the refrigeration system 10 can be achieved by eliminating the possibility of an isolated temperature anomaly.

Preferably, the circuit controllers 32, 34, 36 employ a conventional proportional+integral (PI) algorithm to achieve the adjustments of the associated EEPR valves 42 to arrive at the target circuit temperatures. Alternatively, the circuit controllers 32, 34, 36 can employ a conventional proportional+integral+derivative (PID) algorithm to regulate the circuits. Other control algorithms for controlling the circuits are also possible, e.g. fuzzy logic based algorithms. An example of an algorithm for calculating the load for a circuit is illustrated by the following equation.

$$L = \frac{1}{T_{Per}}\left(\sum_{i=1}^{n}(T_{act,i} - T_{set}) \cdot \Delta t_i\right)$$

where:

$T_{Per}$ is a sampling period, for example, 20 minutes, $T_{act,\ i}$ is the actual circuit temperature determined n times during each sampling period, $T_{set}$ is the circuit temperature set point, $\Delta t_i$ is the time between each determination of the temperature during the sampling period. The temperature could be measured, for example, 20 times during a period.

The load of the circuits of the refrigeration system are determined for the predetermined sampling period, for example, 20 minutes. After the predetermined period, the master controller 40 selects from the determined circuit load which circuit has the highest load. If the load of the selected circuit is higher than the load of the most loaded circuit determined over the previous time period, preferably by a predetermined load limit which is a predetermined margin above the load of the previously determined MLC, the associated circuit is then selected as the most loaded circuit (MLC) and the master controller 40 takes over the temperature control of that circuit. The remaining circuits are still under the control of the associated circuit controllers. This load limit is set at a value which avoids too frequent switching by the master controller 40. Specifically, the circuit controller associated with the most loaded circuit is set off by the master controller (i.e., the associated EEPR valve 42 is set to 100% open position). Moreover, the master controller 40 takes over the temperature control in the most loaded circuit by changing a Suction Pressure Set Point Offset signal (MCdPs) to the compressor controller 38. In other words, all commands are given relative to a predetermined suction pressure set point, wherein adjustments are determined by the amount of the actual offset relative to the set point. The compressor controller 38 in turn adjusts and sends a compressor capacity signal (CompCap) to the compressor rack 18 to change the compressor capacity so as to move the circuit temperature to the target temperature in the most loaded circuit by changing the suction pressure. All of the remaining circuits are still under the control of the associated circuit controllers. The process of determining and regulating a new most loaded circuit is repeated after the predetermined period (e.g., 20 minutes) has elapsed for as long as the system 10 is in use.

The offset of the suction pressure set point is limited. The magnitude of the limited offset is conveyed from the compressor controller 38 to the master controller 40 by means of a dPsMin signal. If the suction pressure set point offset (MCdPs) is limited by the minimum suction pressure set point (dPsMin), the master controller 40 continues at the minimum suction pressure set point in order to avoid losing control over the system should the system fail such as, for example, by means of a faulty sensor.

If a circuit is in defrost mode or within a predetermined period of time after completion of the defrost mode, or if the circuit has been taken out of service the circuit cannot be selected as the most loaded circuit by the master controller 40. If the most loaded circuit is forced out of normal cooling mode such as when being defrosted, the master controller 40 immediately selects a new most loaded circuit. In other words, the master controller 40 selects only those circuits where the circuit condition information sent by a circuit controller to the master controller shows that the circuit is in a normal cooling mode.

While a preferred embodiment has been shown and described, various modifications and substitutions may be made without departing from the spirit and scope of the present invention. Accordingly, it is to be understood that the present invention has been described by way of example, and not by limitation.

What is claimed is:

1. A method for regulating a most loaded circuit in a multi circuit refrigeration system comprising the steps of:

a. providing a refrigeration system having a compressor rack including at least one compressor and two or more circuits, each of the circuits including at least one refrigeration case and having an electronic evaporation pressure regulator valve coupled to the circuit;

b. providing at least one controller in communication with the electronic evaporation pressure regulator valves for monitoring each circuit, including sensor dependant signals, in particular temperature signals and for issuing command signals to the electronic evaporator pressure regulator valves and the at least one compressor;

c. calculating a load signal for each circuit based on said monitored sensor dependant signals;

d. comparing the load signals for each circuit and determining the most loaded circuit;

e. adjusting the electronic evaporation pressure regulator valve associated with the most loaded circuit to be approximately 100 percent open and controlling a suction pressure of the at least one compressor in response to commands issued from the at least one controller in order to move a circuit temperature of the most loaded circuit to a target temperature; and f. repeating steps c through e after a predetermined period of time.

2. The method of claim 1, wherein the at least one controller includes:

a plurality of circuit controllers, each of the plurality of circuit controllers communicating with one of the circuits;

a compressor controller for increasing or decreasing a suction pressure of the at least one compressor; and a master controller for directing the operation of the circuit controllers and the compressor controller.

3. The method of claim 1, wherein the circuit temperature includes one of: a temperature of a case having the highest temperature in a circuit, a temperature of a case having the lowest temperature in a circuit, a temperature of a predetermined case in a circuit, an average of the temperatures of the cases in a circuit, and a weighted average of the temperatures of the cases in a circuit.

4. The method of a claim 1, wherein the load signal of an associated circuit is derived from an average of a deviation of a current circuit temperature relative to a target circuit temperature over a predetermined period of time.

5. The method of claim 1, wherein the step of calculating a load signal for each circuit is determined by the equation $$L = \frac{1}{T_{Per}}\left(\sum_{i=1}^{n}(T_{act,i} - T_{set}) \cdot \Delta t_i\right)$$

where:

$T_{per}$ is a sampling period, $T_{act,\,i}$ is the actual circuit temperature determined n times during each sampling period, $T_{set}$ is the target temperature of the circuit, and $\Delta t_i$ is the time between each determination of the temperature during the sampling period.

6. The method of a claim 5, wherein the sampling period is approximately 20 minutes.

7. The method of claim 5, wherein the actual circuit temperature is determined approximately 20 times during each sampling period.

8. The method of claim 1 wherein the step of comparing the load signals for each circuit and determining the most loaded circuit includes the step of excluding any circuit that is in a defrost operation or is within a predetermined period of time after completion of the defrost operation or is taken out of service.

9. The method of a claim 1, wherein determining the most loaded circuit includes selecting a new most loaded circuit if the load of the new most loaded circuit as determined over a predetermined period of time is above that of the load associated with the previous most loaded circuit, by a predetermined load limit.

10. The method of claim 1, further comprising the step of providing a minimum suction pressure limit.

11. The method of claim 1, further comprising the step of providing a maximum suction pressure limit.

* * * * *